US006273583B1

(12) United States Patent
Trisler

(10) Patent No.: US 6,273,583 B1
(45) Date of Patent: Aug. 14, 2001

(54) FOLDING STAR

(76) Inventor: James Trisler, 350 Monte Dr., C-12, Zapata, TX (US) 78076

( * ) Notice: Subject to any disclaimer, the term of this patent is extended or adjusted under 35 U.S.C. 154(b) by 0 days.

(21) Appl. No.: 09/505,764

(22) Filed: Feb. 17, 2000

Related U.S. Application Data

(60) Provisional application No. 60/131,924, filed on Apr. 30, 1999, now abandoned, and provisional application No. 60/123,030, filed on Mar. 4, 1999, now abandoned.

(51) Int. Cl.[7] ..... F21S 6/00

(52) U.S. Cl. ..... 362/121; 362/807; 428/11; 428/12; 428/9

(58) Field of Search ..... 428/11, 12, 9; 362/807, 121; 446/487

(56) References Cited

U.S. PATENT DOCUMENTS

| | | |
|---|---|---|
| 1,433,273 | 10/1922 | Graves . |
| 2,853,598 | 9/1958 | Balthauser . |
| 2,894,345 | 7/1959 | Bushnell . |
| 3,184,366 | 5/1965 | Claude . |
| 3,374,798 | 3/1968 | Samuelson . |
| 3,546,049 | 12/1970 | Kostich . |
| 3,704,367 | 11/1972 | Korb . |
| 3,977,683 | 8/1976 | Tomura . |
| 4,816,310 | 3/1989 | Truyens . |
| 5,629,057 | 5/1997 | Wang et al. . |
| 5,845,451 | 12/1998 | Tolentino . |

*Primary Examiner*—Alexander S. Thomas
(74) *Attorney, Agent, or Firm*—Browdy and Neimark

(57) ABSTRACT

A decorative folding star is made of star pieces, preferably straight strips and/or strips with ends bent to an angle, such as 36°. One end of each strip is fastened to the corresponding end of an adjoining strip. When all the star pieces are end-coupled, they form a topological loop. The structure is reinforced with extra fasteners at the crossing points. When these reinforcements and also one of the end fasteners are removed, the pieces can fold about the pivots of the remaining end fasteners and the star collapses for shipment or storage. The ends may be offset to provide clearance and aid in folding. The end fastener may be shaped to permit rotation only in the direction toward the collapsed position of the star. Lights or light holders may be mounted on the strips.

19 Claims, 10 Drawing Sheets

FOLDING STAR

CROSS REFERENCE TO RELATED APPLICATION

This application claims the benefit of: provisional application serial No. 60/123,030, filed Mar. 4, 1999 now abandoned, the contents of which are entirely incorporated herein by reference; and provisional application serial No. 60/131,924, filed Apr. 30, 1999now abandoned, the contents of which are entirely incorporated herein by reference.

FIELD OF THE INVENTION

The present invention relates to collapsible and erectable decorations, especially foldable and unfoldable stars.

REVIEW OF THE RELATED TECHNOLOGY

W. L. Bushnell, in U.S. Pat. No. 2,894,345, pictures a five-pointed decorative star made of intersecting and crossing "angle iron" beams each having an L-shaped cross section. Where the beams intersect a portion of one side of the "L" is cut away to allow the other beam to pass, but there is no fixing of one beam to another at the intermediate crossing points. The beams are fastened with fasteners only at their ends. The device cannot be folded for easy shipping and storage, but can only be disassembled.

In one embodiment the ends are fastened by inserting a tab or tongue 18 through a "keeper slot" 19 and bending the tab over; this prevents any rotation of the beams. In another embodiment a boss 26 is inserted through a keeper hole 27 "where it is then peened in place and held" (col. 2, line 55). It is therefore clear that this star is not foldable, i.e. is not a knock-down star, because the end fasteners are permanent and irrotational, and because the "angle iron" is too stiff to permit the beams to be bent away from one another.

U.S. patent 3,977,683 to Tomura discloses a toy or puzzle with numerous flexible strips ("links") including end-fasteners by which the strips are joined into quadrilaterals and other figures. There are no means for fastening the strips at intermediate cross-over points. Tomura does not disclose any star shapes.

Claude, U.S. Pat. 3,184,366, shows a knock-down decorative five-pointed star in which each of the five straight arms making up the star is jointed in the middle. That is, there are a total of ten strips which in pairs make up the five straight arms of the star. Each of the two strips of each pair of strips is also joined to a strip of an adjoining straight arm (which also is made up of two strips). All the joints are pivotal, and when some of the fasteners are removed the star folds up accordion-style into a compact bundle as long as each of the strips.

The Claude star has the advantage of being short—half of the arm length—when collapsed. However, this advantage is gained at the cost of structural weakness and increased cost. Each arm is able to flex about the mid-point joint. Each of the triangular outer portions of the star includes a joint in one of its three arms, and can collapse. Because of this inherent lack of rigidity, the arms of the Claude star must be jointed at each one of the crossing points 16. Claude uses the crossing point pivots 16 as part of the folding scheme, as shown in FIGS. 6–9; and the Claude device is unduly expensive.

SUMMARY OF THE INVENTION

A decorative star according to the present invention is constructed with five or six strips, preferably flat and elongated and with rounded ends so as to generally resemble tongue depressors. Preferably all strips have the same dimensions. The strips include through holes by which they may be attached, with any sort of fastener or else by a snap-together fastening. The star collapses when certain fastenings are removed.

Preferably each strip has a hole near each end, preferably centered in the rounded region so that a smooth outline is formed when the strips are joined at their edges. By fastening these end holes various sorts of stars can be formed. The stars are stabilized by with additional fastenings, such as additional fasteners through intermediate holes or alignment structures built into the strips, spaced from the end holes by specific amounts.

Preferably, only enough intermediate holes are provided so that there is the minimum number needed to stabilize the star, by triangulation, so that it does not accidentally fold up when in its fixed and erected form. With the number of holes minimized, construction is faster and more simplified. To aid assembly the strips may be labeled.

For example, a five-pointed star made of strips with end holes 23.5 inches apart on centers will have intermediate holes spaced 9 inches from the end holes. (These dimensions of course may be scaled up or down with the ratio remaining substantially the same.) Two of the strips (each preferably labeled "#1" for assembly) will have one such hole each, while a third strip (preferably labeled "#2") will have two intermediate holes, each 9 inches from the respective nearest end hole. Finally, two more strips (each preferably labeled "#3") will have no intermediate holes.

The star is knock-down, and begins to collapse and fold when several intermediate fastenings have been removed. Not all of the fastenings need be removed to achieve an easily-transported compact assembly.

BRIEF DESCRIPTION OF THE DRAWING

The objects and the nature and advantages of the present invention will become more apparent from the following detailed description of embodiments taken in conjunction with drawings, wherein.

DETAILED DESCRIPTION OF THE PREFERRED EMBODIMENT

Here, and in the following claims:

"Fastening" means (1) any adaptation to a star piece intended or useful for joining one star strip, leg or piece to another star strip, leg or piece, or for stabilizing one piece relative to the other; for example, including (but not limited to) interconnecting or interfitting structures (e.g., teeth and indentations), or snaps, hook or loop material (e.g. VELCRO), buttons and holes, pegs, studs, screws, nuts and bolts, cotter pins, and other fasteners; or (2) any associated separate items such as snap rings, pins, hook and eye portions, etc., which cooperate with a star piece adaptation. For example, holes in the star pieces, and bolt/nut combinations to align and fasten the holes, would both be within the meaning of "fastening". A "fastening" may be permanently coupled to the fastened star piece(s) or releasably or removably coupled to the fastened star piece(s). "Integral" means formed of or including at least one single piece of material. "Loop" means topologically equivalent or analogous to a ring, a belt, a chain with end links joined, or any similar device. Pieces fastened or coupled together form a loop when an insect can crawl over all of the pieces in sequence without jumping from one to another (except perhaps at fastenings). "Releasable", of a fastening, means that the fastened pieces can be separated and re-fastened. "Topological" has the usual mathematical meaning of permitting continuous deformation but not permitting any breaking, tearing, or other added discontinuity. "Unitary" means without any means for being dissembled, i.e., not knock-down and not to be taken apart without damage.

A first preferred embodiment of the present invention for making a five-pointed star is illustrated in FIGS. 1–5.

Figure 1:
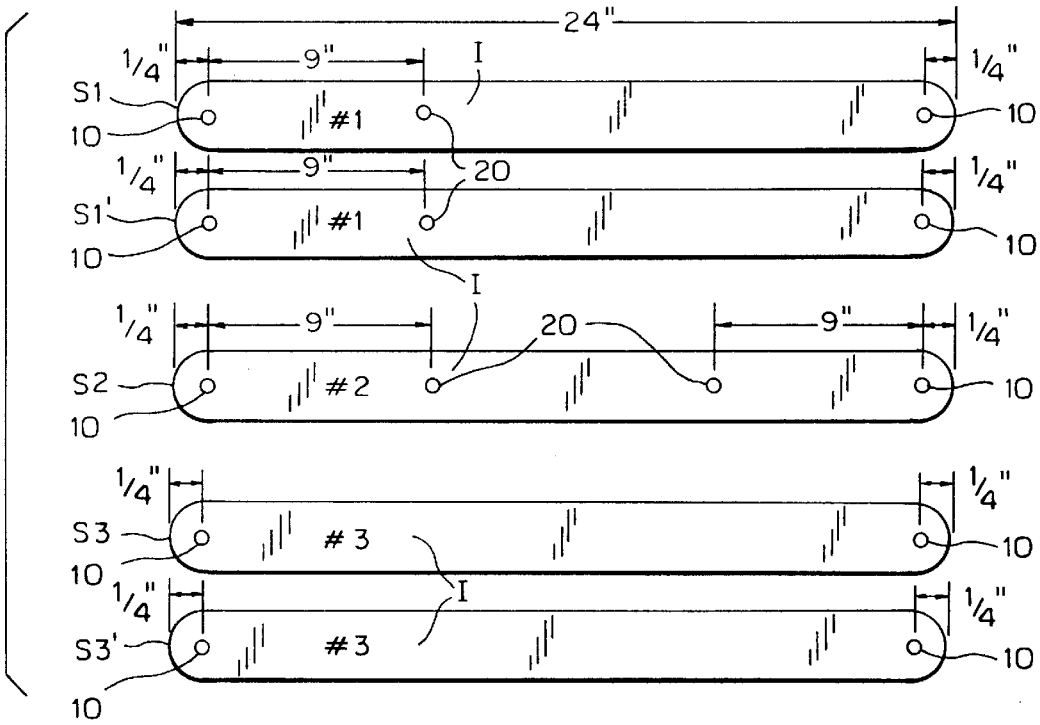
FIG. 1 is a plan view of the strips of the invention.

The strips (star pieces) of the invention, S1, S1', S2, S3, and S3,' are shown in FIG. 1. The preferred dimensions are ⅛ inch by ½ inch in cross section and 24 inches long. Any material may be used for the strips, such as metal, wood, or plastic. The strips may have any cross sectional shape (though rectangular is preferred) and any outline in plan view (though straight with rounded ends as illustrated is preferred).

The strips are preferably labeled with indicia I, including a legend such as "#1" on strips S1 and S1', "#2" on strip S2, and "#3" on strips S3 and S3'. Any indicia helpful in assembling the invention is within the scope of the invention.

Each strip has an end hole 10 at each end, preferably centered in the strip end rounded to a ¼-inch radius. Strip S2 has one intermediate hole 20 preferably located approximately 9 inches from one end hole 10. Strips S3 and S3' each has two intermediate holes 20 preferably located approximately 9 inches from either end hole 10.

Figure 2:
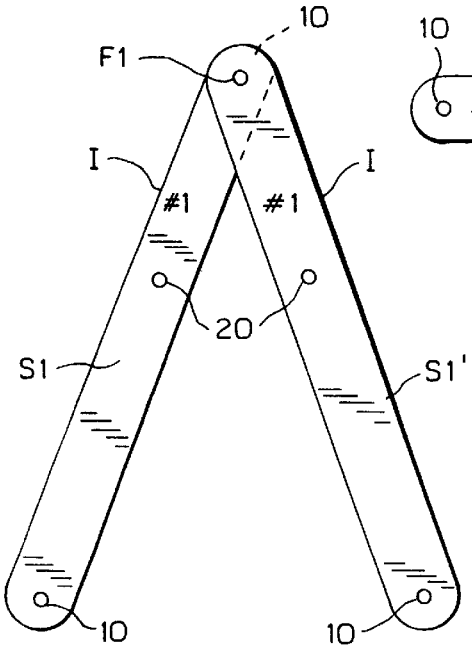
FIG. 2 is a plan view of a first stage of assembly of a first embodiment of the invention.

FIG. 2 shows the initial stage of assembly of the star. Strips S1 and S1' are assembled by placing a first fastening F1 through both holes 10 of the strips S1, S1' as shown. The fastenings may include rivets, bolts, pins, brads, threads, rings, or other fasteners, or other means for fastening. Preferably the indicia I is located closest to the holes 10 which are closest to the holes 20 on either strip S1, S1', which are the holes 10 which are coupled by the fastening F1.

Figure 3:
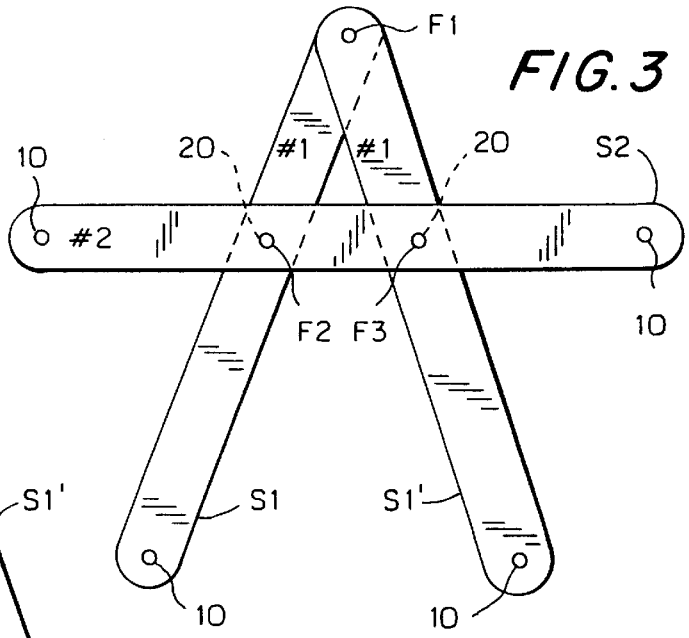
FIG. 3 is a plan view of a second stage of assembly of the invention.

FIG. 3 shows the second stage of assembly of the star. Strip S2 is assembled to the by placing second and third fastenings F2 and F3 through all four holes 20 of the strips S1, S1', and S2, as shown. The indicia I "#2" may be is located as shown or else centrally.

Figure 4:
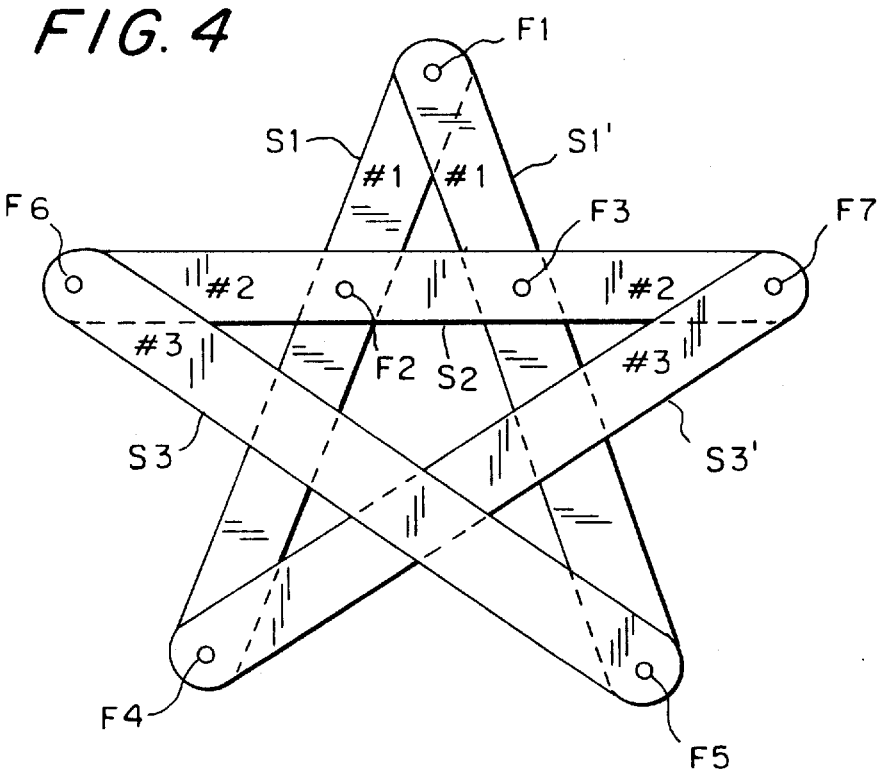
FIG. 4 is a plan view of a third stage of assembly of the invention.

FIG. 4 shows a final stage of assembly in which strips S3 and S3' are coupled to strips S1 and S1' via fastenings F4 and F5 and to strip S2 via fastenings F6 and F7. These couplings are made through eight holes 10 in the strips, with each fastening engaging two holes 10. The star is now fully braced and ready for use.

Figure 5:
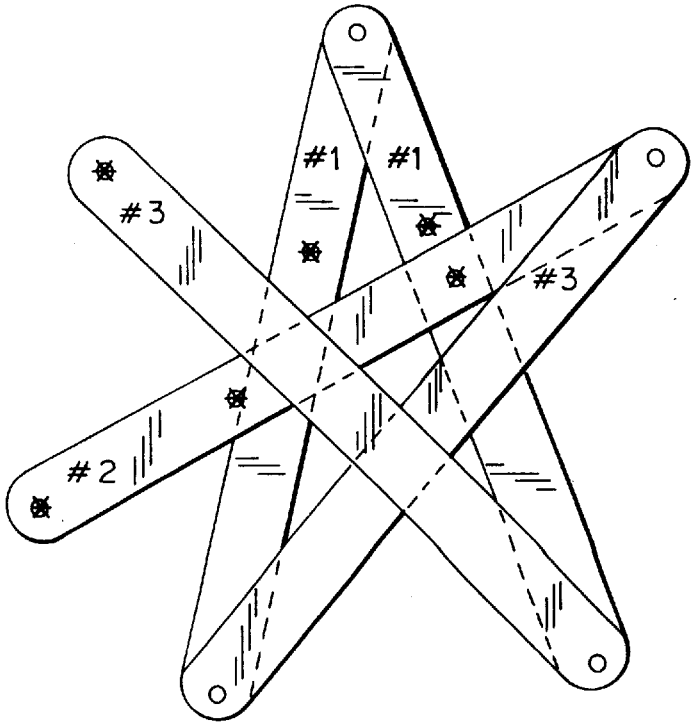
FIG. 5 is a plan view of the assembly partially collapsed.

FIG. 5 shows the star in a partly knock-down state with some fastenings F removed. From FIGS. 5 and 8, for example, it will be apparent that at least some of the fastenings may be permanent, e.g. rivets or the like, so long as hey are sufficiently loose to act as pivots during folding (collapsing) and unfolding (erection).

The present invention comprises various other combinations of strips with through-holes at the ends and selectively at certain places along the lengths of selected strips, to simplify assembly by reducing the total number of fastenings used in the holes, and it also covers any combinations of strips with indicia related to the pattern of holes on respective strips to further aide in assembly. Beside a five-point star, these features of the present invention can be applied to a stars and other shapes having three, four, six, or any other numbers of points (preferably formed by coupling at least two end holes 10) protruding from a regular (or irregular) geometric shape, especially a shape formed by inserting fasteners through at least two intermediate holes 20 or otherwise fastening them. A six-strip star is discussed below.

Figure 6A:
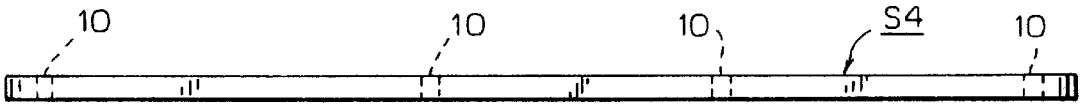
FIGS. 6A–6B are respectively an elevational view and a plan view of a first type of strip used in a second embodiment of the invention.
Figure 6B:
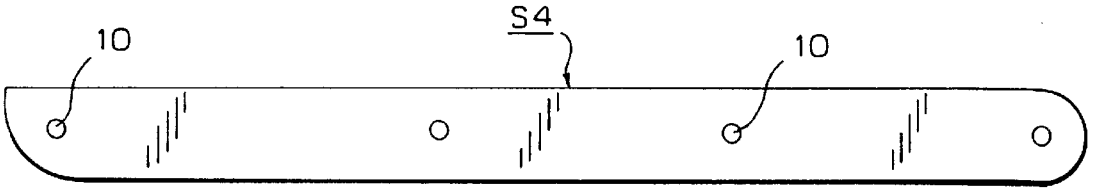
Figure 6C:
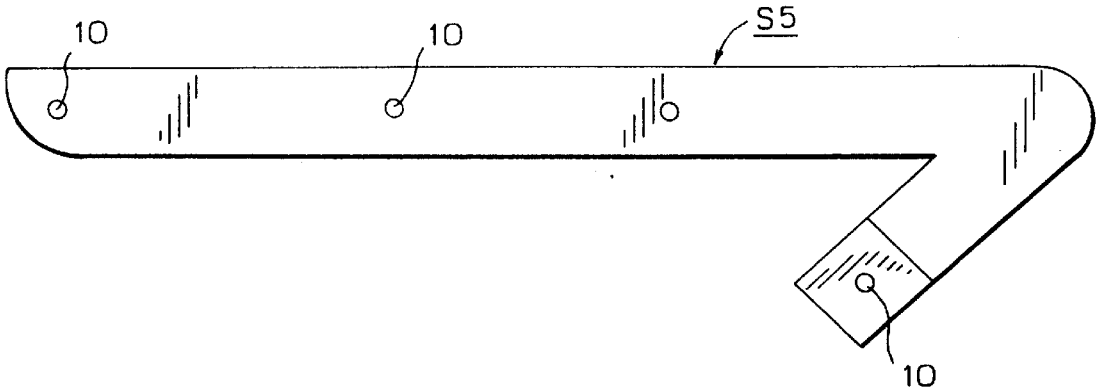
FIGS. 6C–6D are respectively a plan view and an elevational view of a second type of strip used in the second embodiment of the invention.
Figure 6D:
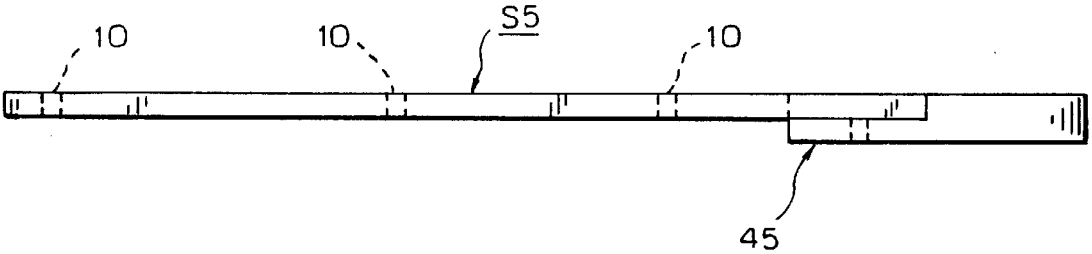

A second embodiment of the present invention is shown in FIGS. 6A–6D, 7, and 8. It is made of four J-shaped strips S5 each bent to an angle such as 36°, and one I-shaped strip S4. FIG. 6D shows how the pivot points of the J-shaped strips S5 are preferably jogged with an offset 45 so the folding star can be folded without damage to light holders or lights. The lights, not shown in these figures, are described below.

Figure 7:
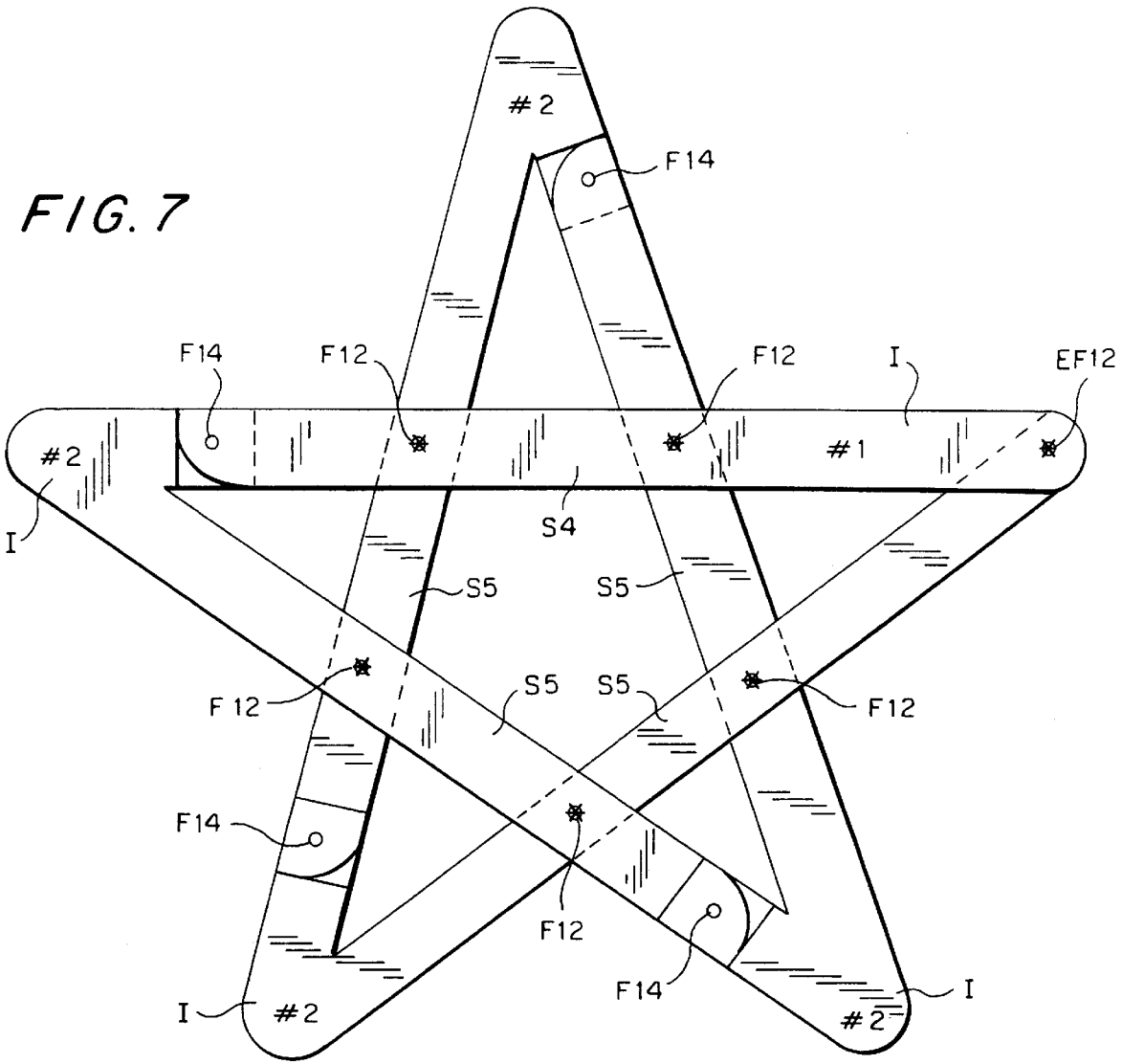
FIG. 7 is a plan view of the erected second embodiment.
Figure 8:
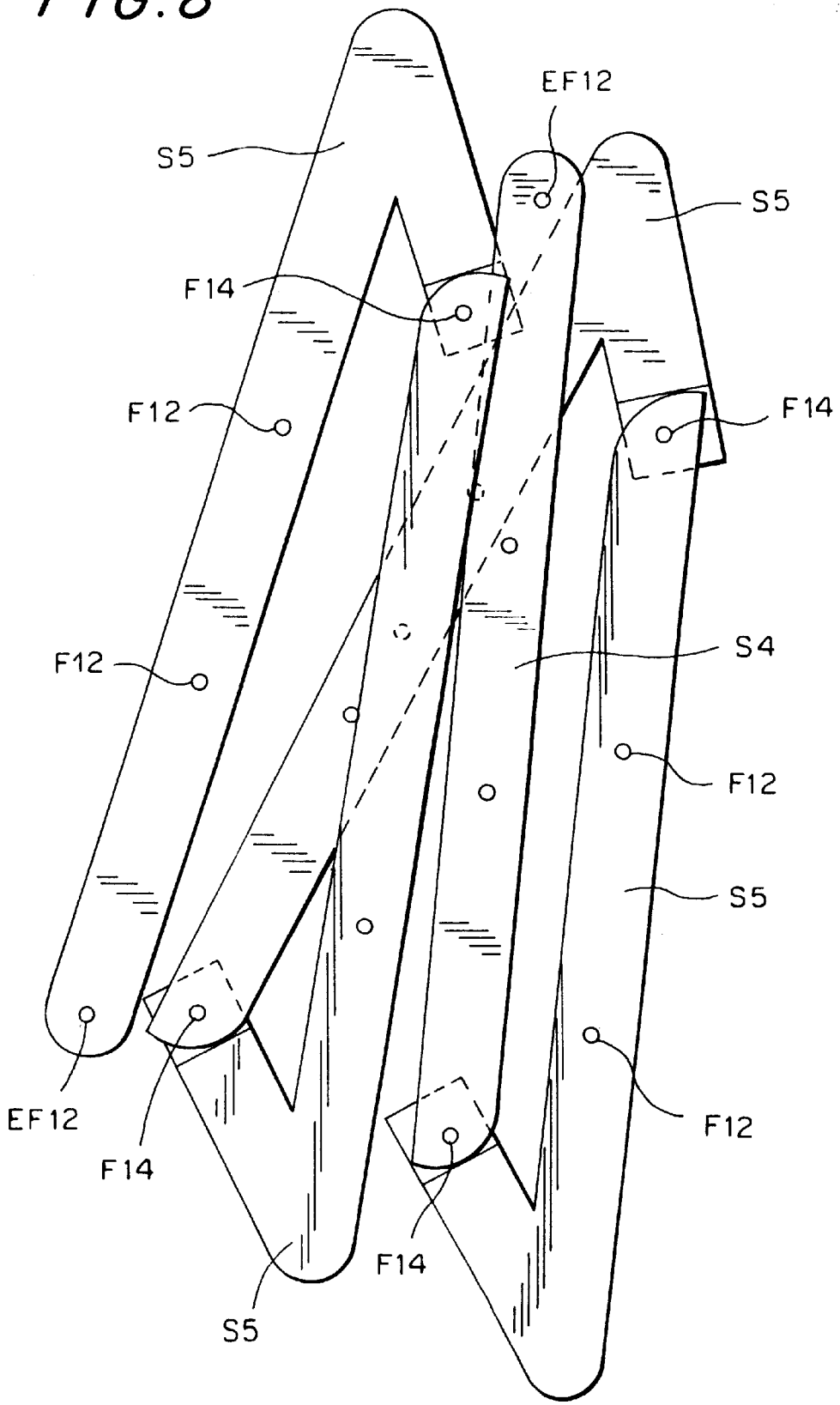
FIG. 8 shows the embodiment of FIG. 7 in a collapsed state.

FIGS. 6A–6D show the holes 10 which are preferably part of the fastening, while FIGS. 7–8 refer to the fasteners themselves. (The holes may of course be considered as parts of a fastening.) In FIG. 8 the end holes are labeled by the fastener nomenclature "EF12" for clarity.

FIG. 7 shows the folding star in an unfolded or erected condition and locked into place with locking means (fasteners) F12 at the crossing positions and one end fastener EF12 (the rightmost fastener F12 shown in FIG. 7). The locking means preferably include fasteners of one type or another, e.g. screws, removable and replaceable rivets, nuts and bolts, pins or the like, but may also include VELCRO, glue, and other attachments. By removing these the folding star will start to fold into a triangle. By removing one outside fastener (e.g., the end fastener EF12), the folding star will fold along the pivots F14 to less than a 6-inch structure from a 48-inch star, the folded position being shown in FIG. 8.

As shown in FIG. 8, the offset holes let the star fold up with holders on the strips and with an arm at the end of the folded star. With the thickness offset portions, folding is possible even with the provided light bulb holders of FIGS. 9 and 10 (discussed below) so the device can be stored or shipped in relatively small boxes. The strips can be made by injection molding or the like from plastic or other moldable material. Other forms of fabrication can also be utilized.

It will be seen for example in FIG. 7 that the intermediate portions of the strips cross over one another and interleave; the offsets 45 facilitate this crossing-over. The star structure is continuous, a topological loop: It is possible to repeatedly travel over the entire erected star, so that a small insect crawling along the strips S would never reach an ending point so long as the star were erected. This is because each end is coupled to a respective second end of the next star piece (strip) by an end fastener. When the star were collapsed as in FIG. 8, the insect would be stopped at the holes of disconnected fastenings EF12, and the structure would no longer be topological loop.

The drawing shows how the preferred construction of the pivot fastenings F14, in which holes at the end of each strip which serve as hinge lines. Each strip is rounded at one end, and half rounded on the end that connects to the next strip. The provision of half rounded strips ensures that each strip will fold in only one direction and unfold in only one direction. As the strips are unfolded to erect the star, they will automatically open up to the star shape. Using five bent strips S5, there are no loose ends in the folded position and it is only necessary to fix the structure by using one or more fasteners at one or more of the intermediate positions as shown.

On the folding star frame, garlands can be placed to make the frame stand out during daylight hours. One can place adhesive holders on the strips and clip on mini lights or even wrap lights around the outside of frame to be seen at night. The strips from which the star is made can be provided with mini light holders fused to the strips all in one piece, e.g. the light holders can be integrally molded with the strips, e.g. from plastic.

Figure 9:
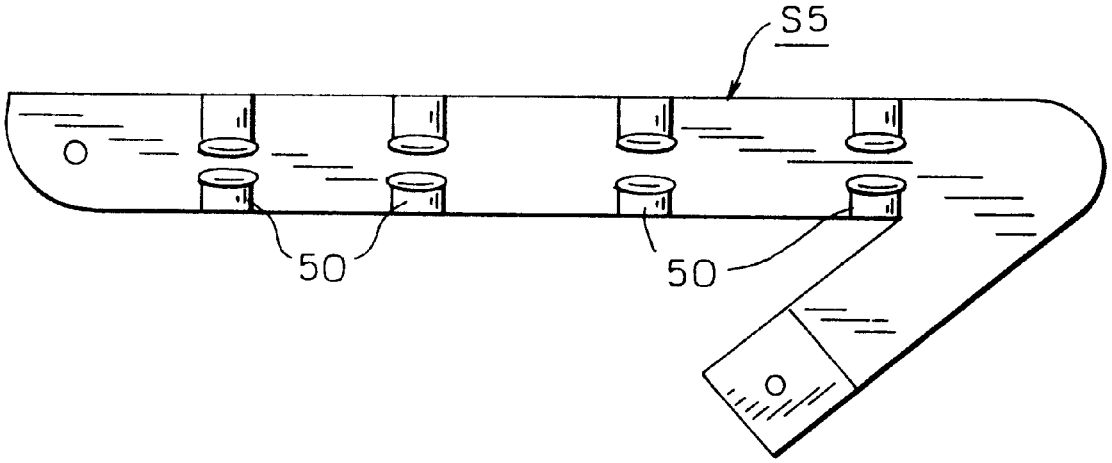
FIG. 9 shows a strip with light fixtures in plan view.
Figure 10:
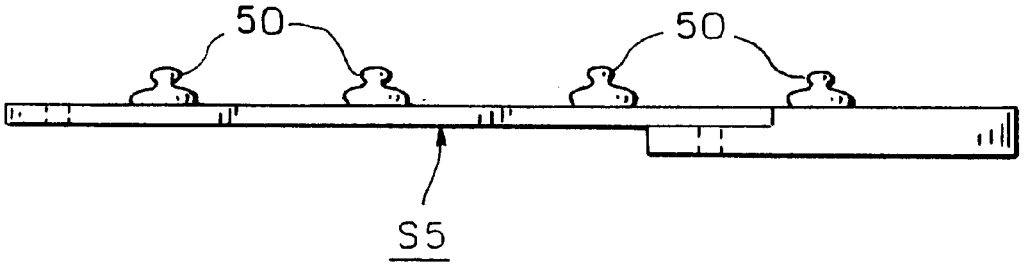
FIG. 10 shows the strip of FIG. 9 in elevational view.

FIGS. 9 and 10 show a variation in which light-bulb holders 50 are provided on the folding arms or strips S, e.g. by being molded therein or otherwise provided, these being adapted to receive various sized light bulbs depending on the size of the strips, e.g. for home use light bulbs of the christmas-tree variety. These strips or arms S can be made by injection molding with light holder cavities molded therein or by uniting light holders with the molten plastic in the die to form light holders mounted to the strips.

Figure 11:
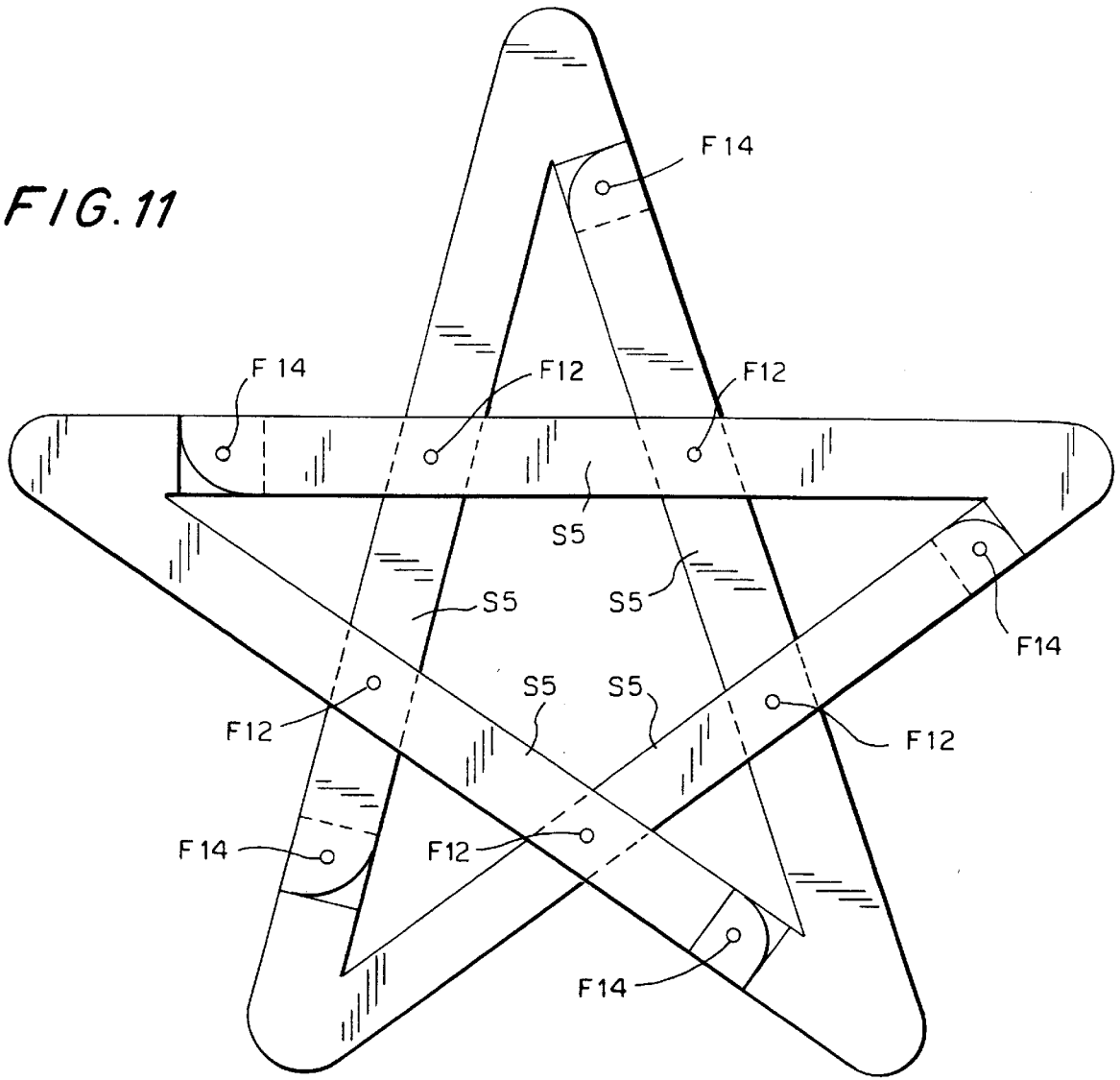
FIG. 11 is a plan view of a third embodiment of the invention in an erected state.
Figure 12:
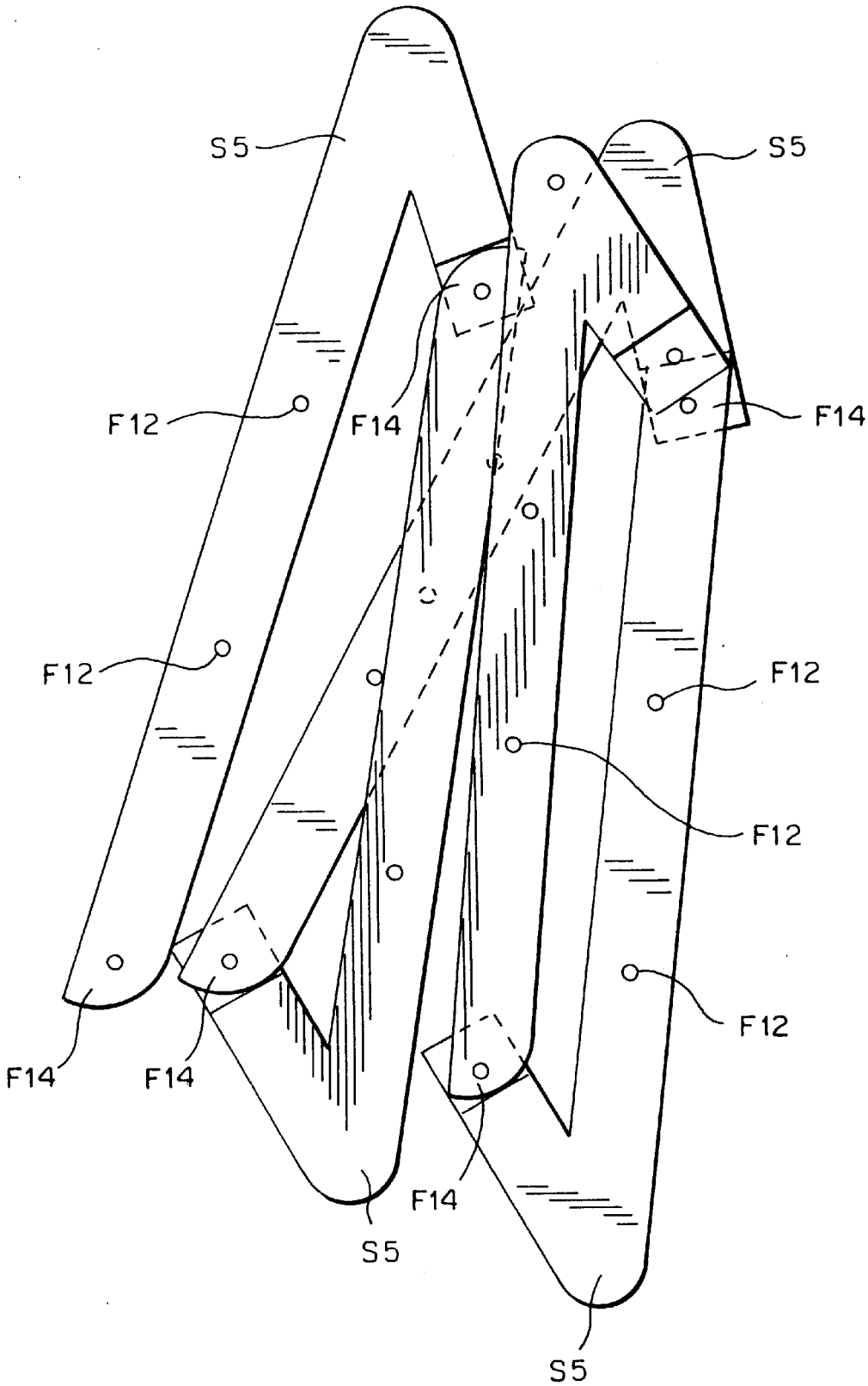
FIG. 12 shows the embodiment of FIG. 11 in a collapsed state.

FIGS. 11 and 12 illustrate a third preferred embodiment which is similar to that of FIGS. 7–8 except all of the arms or strips are the J-shaped star members S5 shown in FIGS. 6C and 6D. FIG. 11 shows the erected or unfolded position, with intermediate holes lined up for one or more removable intermediate fasteners F12 to be inserted. FIG. 12 shows the collapsed position or folded position, but not completely closed.

Figure 13:
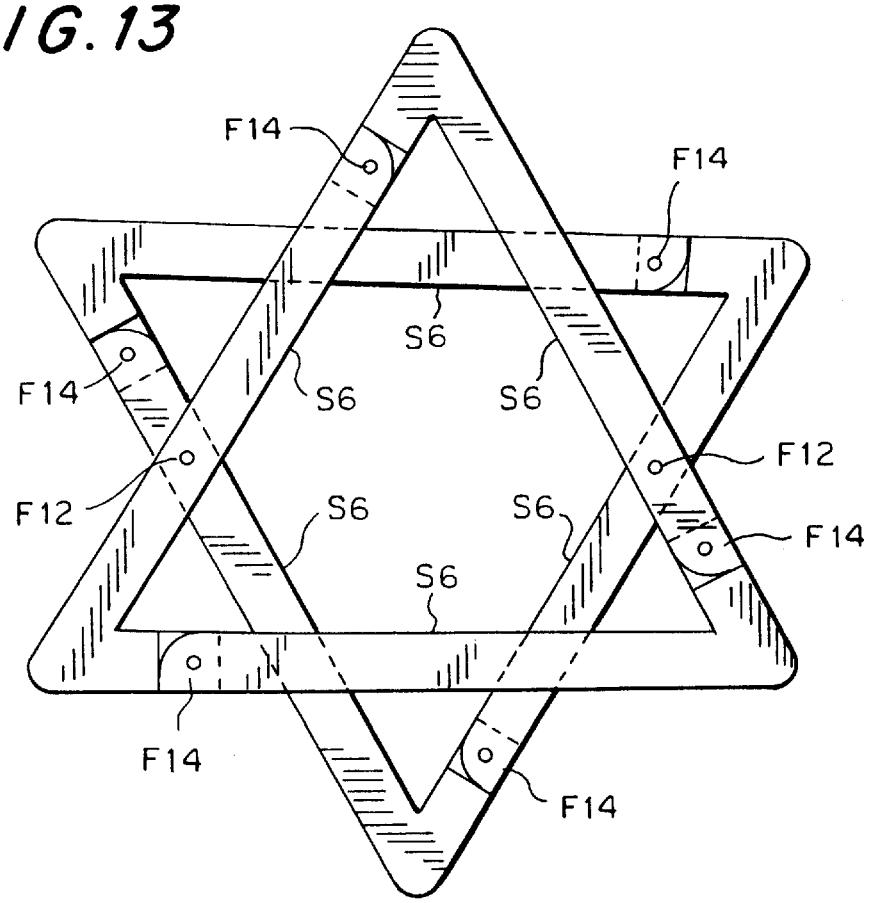
FIG. 13 is a plan view of a fourth embodiment of the invention, a six-pointed star, in an erected state.
Figure 14:
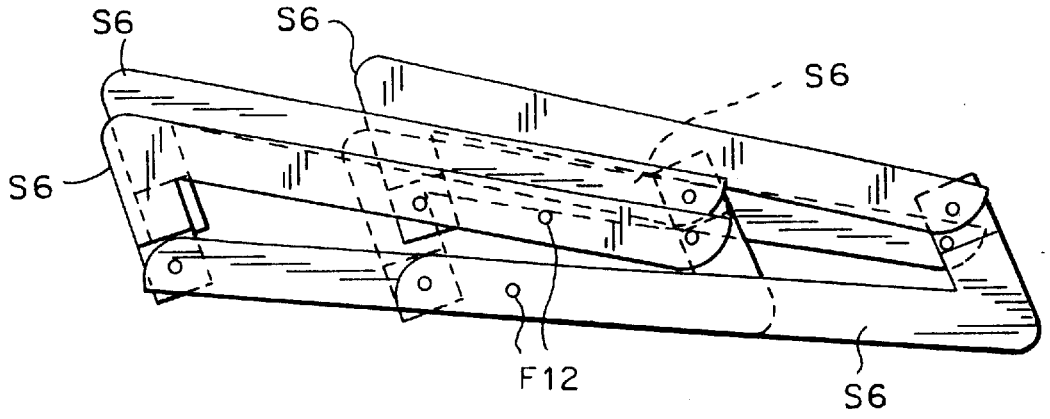
FIG. 14 shows the embodiment of FIG. 13 in a collapsed state.

A six-pointed star is shown in FIGS. 13 and 14. There are six J-shaped star pieces S6, similar to the J-shaped star members S5 of FIG. 11 except for the elbow angle. As in the previously-discussed embodiment pivot fastenings F14 couple the star members. However, because of the number of points the star members are divisible into two sets of three, each forming a stable equilateral triangle, joined by two intermediate fasteners F12; when these are removed the two triangles are separable. Each triangle can then be collapsed by unfastening one of the pivot fastenings F14. The result is shown in FIG. 14, where the pivot fastenings F14 are not labeled to avoid clutter.

A fifth embodiment of the invention is shown in FIGS. 15–18B. This embodiment uses tooth-and-indentation fastenings at the intermediate points. Because the star pieces are made of plastic they can be bent far enough apart to unfasten and permit the star to fold up.

Figure 15:
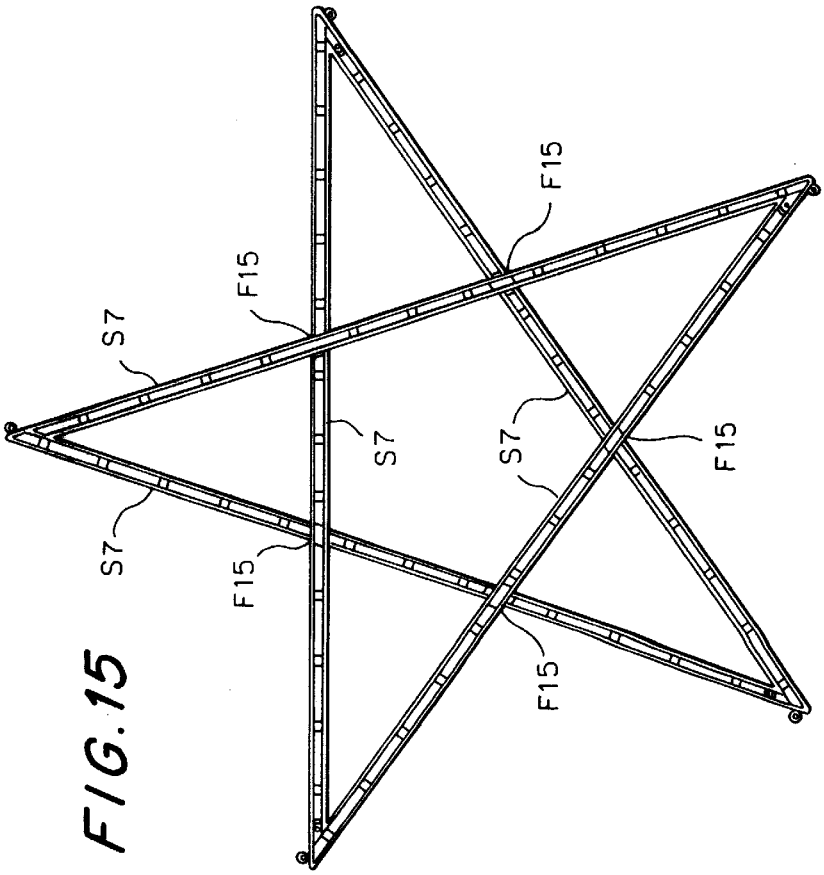
FIG. 15 is a plan view of a fifth embodiment.

FIG. 15 shows this embodiment in overview. The pieces which in the other embodiments are flat strips are embodied here as U-shaped channels S7. The intermediate fastenings F15 include interfitting tooth-and-indentation structures where the channels cross. Like the embodiment of FIGS. 6A–6D, 7, and 8, the pieces include J-shaped legs S5 each bent to an angle, but unlike the other embodiment it includes five, not four, pieces with a J-shape.

Figure 18B:
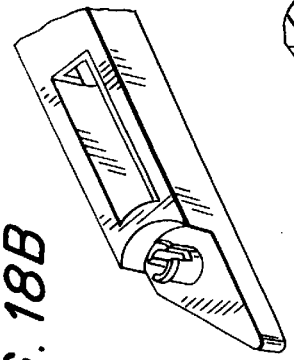
FIG. 18B is a detailed perspective view of another end of the leg of FIG. 16.
Figure 18A:
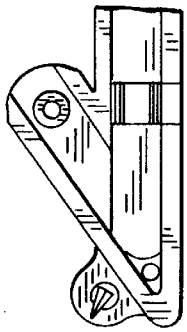
FIG. 18A is a detailed perspective view of one circled end of the leg of FIG. 16.
Figure 16:
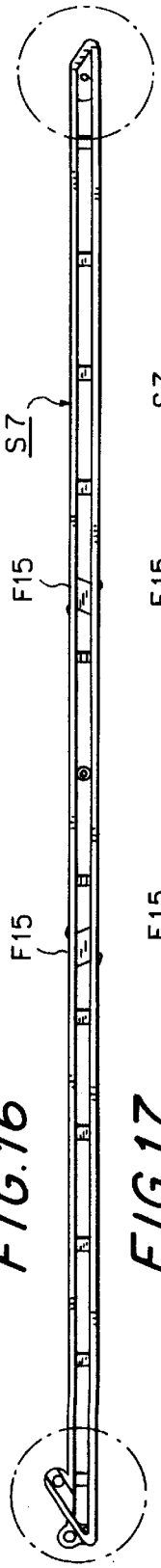
FIG. 16 is a plan view of one leg of the embodiment of FIG. 15.
Figure 17:
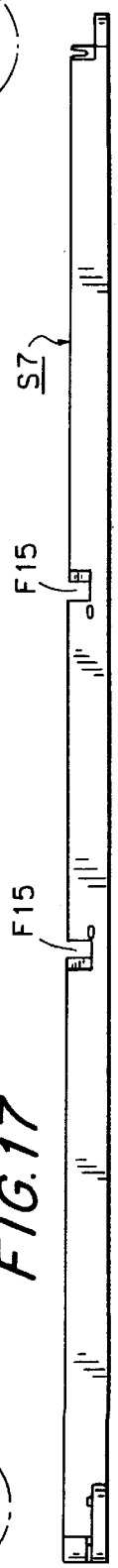
FIG. 17 is an elevational view of the leg of FIG. 16.

FIG. 16 is a detailed plan view of one leg S7 of the embodiment of FIG. 15, and FIG. 17 is an elevational view of the same leg. The J-shaped end of the leg is shown in the detail view of FIG. 18A, as indicated by a circle in FIG. 16, and the opposite end is shown in FIG. 18B, as shown by the other circle in FIG. 16. FIG. 18B shows the underside of the leg S7.

The following claims refer to an orientation of the star pieces in the erected, not collapsed, position.

The foregoing description of the specific embodiments will so fully reveal the general nature of the invention that others can, by applying current knowledge, readily modify and/or adapt for various applications such specific embodiments without undue experimentation and without off departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

What is claimed is:

1. A foldable, erectable and re-foldable star construction having a plurality of star points, comprising:

a plurality of unitary star pieces each having a first end and a second end, at least one of the said star pieces having its ends at respective star points, each first end being rotatably coupled to a respective second end of a different one of the star pieces by a respective end fastener, whereby the star pieces are end-coupled into a topological loop; and at least one pair of the star pieces being mutually fastened at intermediate points thereof by an intermediate fastening, the intermediate points being disposed between the first end and the second end of each star piece of the pair to lock said piece in an erected star configuration;

wherein the intermediate fastening is releasable for collapsing the folding star; and wherein at least one end fastener is releasable and the remainder of said end fasteners constitute pivot axes.

2. The foldable star according to claim 1, wherein the star pieces comprise substantially straight strips.

3. The foldable star according to claim 1, wherein the star pieces are substantially straight at the first end and are bent to an angle at the second end.

4. The foldable star according to claim 1, wherein a first terminal one of the star pieces is pivotally fastened at the second end thereof to the first end of a first other one the star pieces, and a second terminal one of the star pieces is pivotally fastened at the first end thereof to the second end of a second other one the star pieces, and the first terminal end is releasably fastened to the second terminal end.

5. The foldable star according to claim 1, wherein the end fastener permits rotation of the star pieces joined thereby in a single direction, the single direction being toward a collapsed position of the star.

6. The foldable star according to claim 1, comprising lights.

7. The foldable star according to claim 1, comprising light holders.

8. The foldable star according to claim 1, wherein the unitary star pieces are integral.

9. The foldable star according to claim 1, wherein exactly one pair of the star pieces is mutually fastened, at respective intermediate points, by respective intermediate fastenings.

10. The foldable star according to claim 1, wherein exactly two pairs of the star pieces are mutually fastened, at respective intermediate points, by respective intermediate fastenings.

11. The foldable star according to claim 1, wherein exactly three pairs of the star pieces are mutually fastened, at respective intermediate points, by respective intermediate fastenings.

12. The foldable star according to claim 1, wherein exactly four pairs of the star pieces are mutually fastened, at respective intermediate points, by respective intermediate fastenings.

13. The foldable star construction of claim 1, wherein the number of said star pieces is equal to the number of star points.

14. The foldable star construction of claim 13, wherein said plurality of first fastening members consist of four fastening members each forming a pivot connected between a respective pair of unitary star pieces.

15. A foldable, erectable and re-foldable star construction having a plurality of star points, comprising:

a plurality of unitary star pieces equal in number to the plurality of star points;

a plurality of first fastening members fastening said unitary star pieces together in succession while leaving two of said star pieces, that will be adjacent one another when said construction is erected, free to move relative to one another; and a second fastening member for detachably securing said two star pieces directly to one another.

16. The foldable star construction of claim 15, wherein said second fastening member consists of interfitting structures forming parts of said two star pieces.

17. The foldable star construction of claim 15, wherein said plurality of first fastening members consist of four fastening members each forming a pivot connected between a respective pair of unitary star pieces.

18. The foldable star construction of claim 15, wherein each of said unitary star pieces is a molded plastic piece.

19. The foldable star construction of claim 15, wherein said plurality of star pieces consist of five star pieces.

* * * * *